US005445466A

United States Patent [19]

Mukunoki

[11] Patent Number: 5,445,466

[45] Date of Patent: Aug. 29, 1995

[54] LIQUID APPLICATOR WITH SCREW LOCK

[75] Inventor: Tadashi Mukunoki, Toyonaka, Japan

[73] Assignee: Kabushiki Kaisha Sakura Kurepasu, Osaka, Japan

[21] Appl. No.: 964,866

[22] Filed: Oct. 22, 1992

[30] Foreign Application Priority Data

Oct. 30, 1991 [JP] Japan ..... 3-089291 U

[51] Int. Cl.[6] ..... B43K 3/00; B43K 8/02

[52] U.S. Cl. ..... 401/199; 401/251; 401/258; 215/330; 215/331

[58] Field of Search ..... 401/251, 258, 199; 411/120, 121, 184, 185, 186, 959, 961, 962; 215/330, 331

[56] References Cited

U.S. PATENT DOCUMENTS

| | | | |
|---|---|---|---|
| 2,128,456 | 8/1938 | Dusenbury, Sr. | 401/251 X |
| 4,279,527 | 7/1981 | Moe et al. . | |
| 4,662,530 | 5/1987 | Goncalves et al. | 215/331 X |
| 4,834,251 | 5/1989 | Yu | 215/330 X |
| 4,930,921 | 6/1990 | Anderka | 401/251 X |
| 5,000,332 | 3/1991 | Whitacre | 215/330 |
| 5,020,682 | 6/1991 | Dutt . | |
| 5,123,556 | 6/1992 | Goldenberg | 215/330 |
| 5,145,080 | 9/1992 | Imbery, Jr. | 215/331 |
| 5,213,225 | 5/1993 | King et al. | 215/331 X |

FOREIGN PATENT DOCUMENTS

| | | | |
|---|---|---|---|
| 1268262 | 6/1961 | France | 215/330 |
| 2036272 | 12/1970 | France . | |
| 2557705 | 6/1977 | Germany | 401/258 |
| 3206998 | 9/1983 | Germany | 401/251 |
| 3941946 | 7/1990 | Germany . | |
| 646323 | 9/1962 | Italy | 215/330 |
| 60-48471 | 5/1985 | Japan . | |
| 455545 | 9/1967 | Switzerland | 215/330 |
| 2105693 | 3/1983 | United Kingdom . | |

*Primary Examiner*—Steven A. Bratlie
*Attorney, Agent, or Firm*—Fish & Richardson

[57] ABSTRACT

First and second engaging projected portions are formed on opposing circumferential surfaces of a tubular casing and a hollow lead portion which are rotated relative to each other so as to be coupled with, thereby spirally engaging external and internal threads formed on the respective opposing circumferential surfaces. A forward side face of the first engaging projected portion with respect to a spiral rotating direction is formed into a slanting face so as to allow the second engaging projected portion to move over the first engaging projected portion when the casing and the lead portion are completely coupled with each other. Further, backward side faces of the first and second engaging projected portions are formed into upright faces, such that the second engaging projected portion cannot move over the first engaging projected portion in an opposite direction once moving over the same. This arrangement reliably prevents the spiral engagement of the casing and the lead portion from loosening.

7 Claims, 6 Drawing Sheets

LIQUID APPLICATOR WITH SCREW LOCK

BACKGROUND OF THE INVENTION AND RELATED ART STATEMENT

This invention relates to liquid applicators including writing instruments such as ball-point pens and paint markers.

In general, the liquid applicators including writing instruments are each provided with a tubular casing for containing liquid to be applied and a hollow lead portion mounted on a lead end of the casing. The easing and the lead portion are coupled with each other by spirally engaging a thread formed on the casing with a thread formed on the lead portion. However, if the spiral engagement of these threads loosens while the liquid applicator is in use, the liquid contained in the casing may leak out and stain documents, clothes, and bodies of users. Particularly, recent years, the toxicity of the liquid has been raised as problem. In this respect, it has become important to prevent leakage of the liquid to be applied.

The following are known as means for preventing loosening of the spiral engagement described above.

(a) A hollow lead portion is provided with an elastic piece having a projected portion, and a tubular casing is provided with a groove-like engaging portion which is spirally engageable with the projected portion of the lead portion. By engaging the projected portion with the groove-like engaging portion, the spiral engagement of the threads becomes resistive to the external force, and therefore the rotation of the lead portion relative to the casing can be restricted (Japanese Unexamined Utility Model Publication No. 57-13284).

(b) Either the casing or the lead portion is provided with a cylindrical portion having a projected portion which serves as a stopper, and the other is provided with an engaging portion which is stopped by the projected portion. Further, in adjacent to the engaging portion is provided a tapered portion which becomes struck against the projected portion, thereby causing the threads to become meshed with each other. In this way, the loosening of this spiral engagement of the two threads can be restricted (Japanese Unexamined Utility Model Publication No. 60-48471).

The liquid applicators disclosed in the above publications are both capable of restricting the loosening of spiral engagement of the casing and the lead portion. However, even in these liquid applicators, the loosening of the spiral engagement still remains possible. Accordingly, there still exists a demand for liquid applicators capable of preventing the loosening of the spiral engagement more reliably.

SUMMARY OF THE INVENTION

In view of the problem residing in the prior art, it is an object of the invention to provide a liquid applicator capable of preventing the loosening of spiral engagement of a casing and a lead portion more reliably.

Accordingly, the invention is directed to a liquid applicator comprising a tubular easing having an external thread formed on an outer circumferential surface thereof; a hollow lead portion having an internal thread formed on an inner circumferential surface thereof, the lead portion being mountable on the casing by spirally engaging the external and internal threads; and an engaging projected portion formed in a specified position on each of the outer circumferential surface of the casing and the inner circumferential surface of the lead portion, the specified positions corresponding to each other in a state where the external and internal threads are completely spirally engaged with each other, these engaging projected portions being formed such that one engaging projected portion is allowed to move over the other in a spiral rotating direction. but is not allowed to move over the other in a direction, opposite to the spiral rotating direction.

Conversely, the internal thread may be formed on an inner circumferential surface of the casing, and the external thread may be formed on an outer circumferential surface of the lead portion.

With the liquid applicator thus constructed, one engaging projected portion is allowed to move over the other engaging projected portion in the spiral rotating direction when the internal and external threads are completely spirally engaged. Once moving over the other engaging projected portion, the one engaging projected portion cannot move over the same in the opposite direction. Accordingly, the casing and the lead portion are prevented from rotating relative to each other in both the spiral rotating direction and its opposite direction, thereby preventing the loosening of the spiral engagement of the threads. Further, a user can recognize that the lead portion is completed coupled with the casing by sounds made when the one engaging projected portion moves over the other.

More specifically, the above effect is obtainable in a more satisfactory manner by forming a forward side face of at least one engaging projected portion with respect to the spiral rotating direction into such a slanting face that the one engaging projected portion is allowed to move over the other, and by forming a backward side face of each engaging projected portion with respect to the spiral rotating direction into an upright face. The backward side face of each engaging projected portion with respect to the spiral rotating direction may be formed into a slanting face which extends in the same direction with the other slanting face.

Further, the loosening of the spiral engagement can be prevented more reliably by means of the fitting or engaging of the engaging projected portion with the following arrangements: 1) A first stepped portion having stages whose heights differ from each other is formed on a face of one engaging projected portion, and a second stepped portion fittable with the first stepped portion is formed on a face of a member mating with the one engaging projected portion; 2) A first rib portion is formed on a face of one engaging projected portion, and a second rib portion fittable with the first rib portion is formed on a face of a member mating with the one engaging projected portion; and 3) One engaging projected portion is formed into a hooked shape curved backward with respect to the spiral rotating direction, and the other engaging projected portion, is formed into a hooked shape which is engageable with the one engaging projected portion.

Moreover, a restricting projected portion may be formed in a position backward of one engaging projected portion with respect to the spiral rotating direction, thereby defining, between the restricting projected portion and the one engaging projected portion a groove in which the other engaging projected portion is fittable. This arrangement prevents the casing and the lead portion from rotating relative to each other in the spiral rotating direction, and therefore an engagement-completed position of the threads can be accurately fixed.

The aforementioned constructions are particularly effective in liquid applicators in which a seal member is held tightly between the casing and the lead portion in a state where the external and internal threads are completely spirally engaged with each other. If the invention is applied to those liquid applicators, the airtightness in the interior of the liquid applicators can be maintained constantly in a satisfactory manner by preventing the loosening of the spiral engagement.

These and other objects, features and advantages of the present invention will become more apparent upon a reading of the following detailed description and accompanying drawings.

view in

Figure 7:
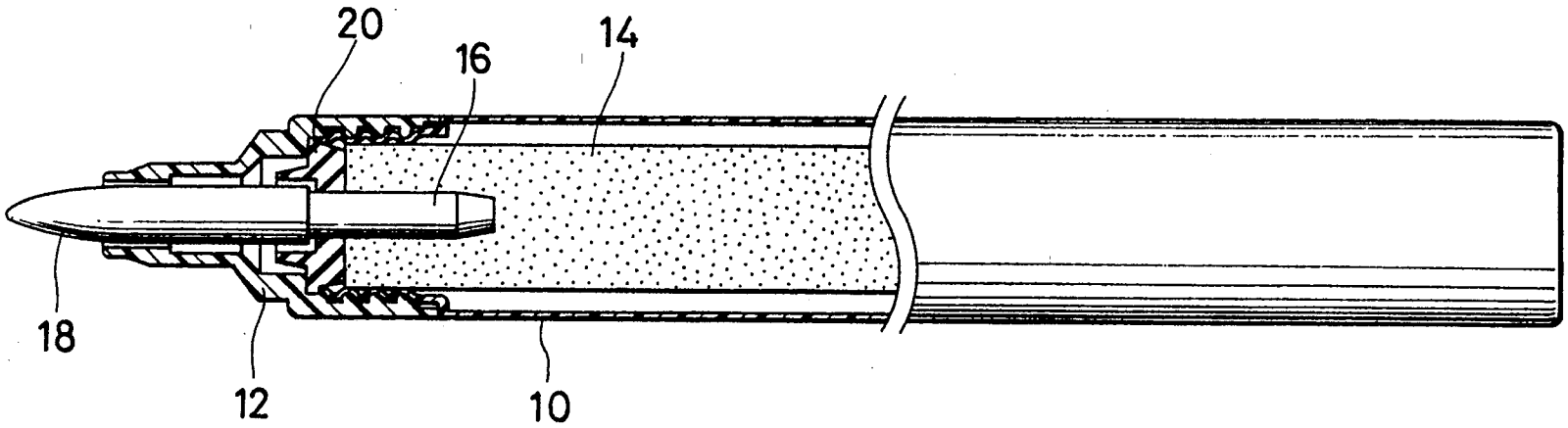
Figure 8:
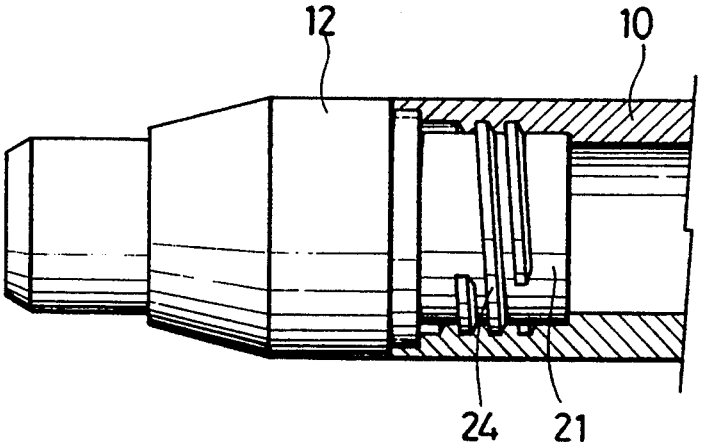
Figure 9:
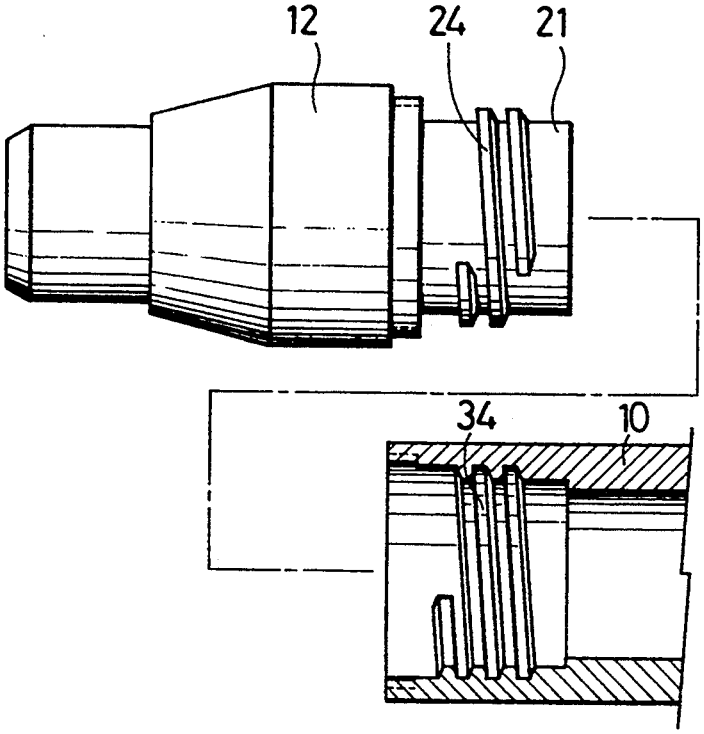
Figure 10A:
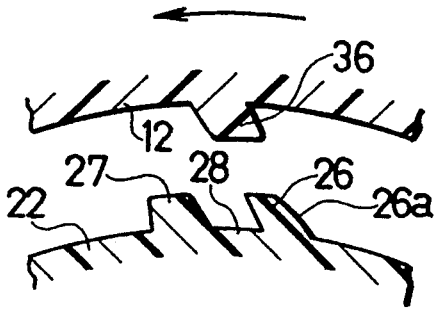
Figure 10B:
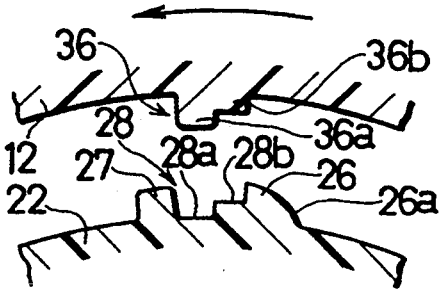

FIG. 7 is a front section showing the entire liquid applicator;

FIG. 8 is a front view in section showing a modification in which features of the casing and the lead portion are switched;

FIG. 9 is a front view in section showing a state of the modification where the casing and the lead portion are disengaged from each other; and FIGS. 10A, 10B. 10C and 10D are sectional views showing modifications of an engaging projected portion.

DETAILED DESCRIPTION OF PREFERRED EMBODIMENTS

An exemplary embodiment of the invention will be described in accordance with the accompanying drawings. The invention is applied to a paint marker in this embodiment. However, the invention is not limited to this application, but is also applicable to various types of liquid applicators in which liquids are contained in casings thereof.

A liquid applicator shown in FIG. 7 is provided with tubular casing 10 and a hollow lead portion 12 having a bore in communication with the plenum in the casing 10. The casing 10 and the lead portion 12 are both formed of elastic material such as synthetic resin. The casing 10 accommodates an ink (liquid to be applied) reservoir 14. The ink reservoir 14 is connected to a shaft 16 having a small diameter and extending from a bottom end of nib 18. A lead end of the nib 18 is projecting forward from the lead portion 12. Further, between the easing 10 and the lead portion 12 is provided a seal member 20 formed of elastic material such as rubber and polyethylene resin.

As shown in FIGS. 1 to 4, a small cylinder portion 21 and a large cylinder portion 22 are mounted on a lead end of the casing 10 in this order from the lead end of the liquid applicator. An external thread 24 is formed on an outer circumferential surface of the small cylinder portion 21. On an outer circumferential surface of the large cylinder portion 22 are formed a pair of a first engaging projected portion 26 and a restricting projected portion 27 in this order with respect to a direction of spiral rotation in two positions circumferentially spaced apart by 180 degrees. Between each pair of projected portions 26 and 27 are defined grooves 28.

Figure 1:
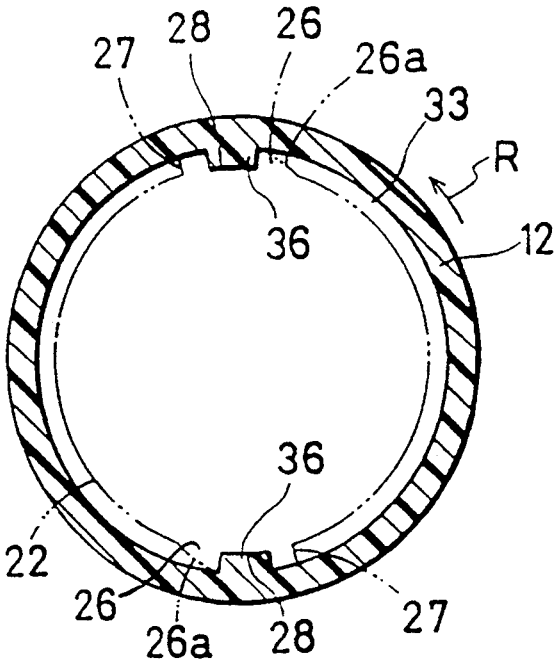
FIG. 1 is a sectional view taken along the line I—I in FIG. 2.
Figure 2:
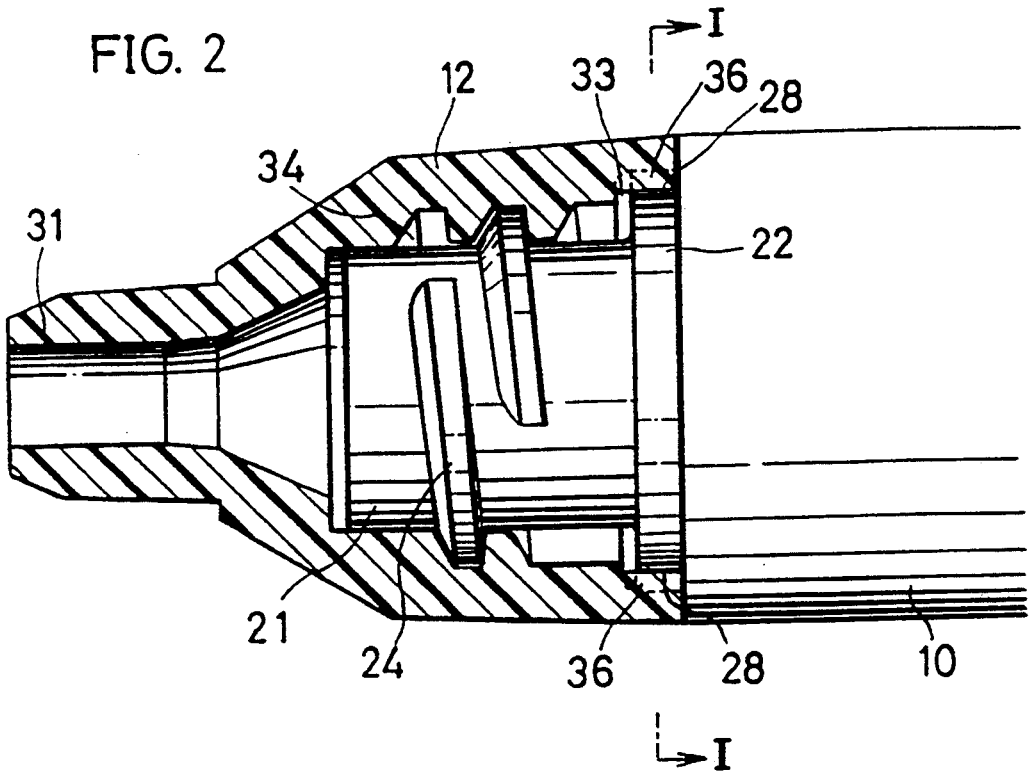
FIG. 2 is a front view in section showing an essential portion of a liquid applicator embodying the invention.
Figure 3:
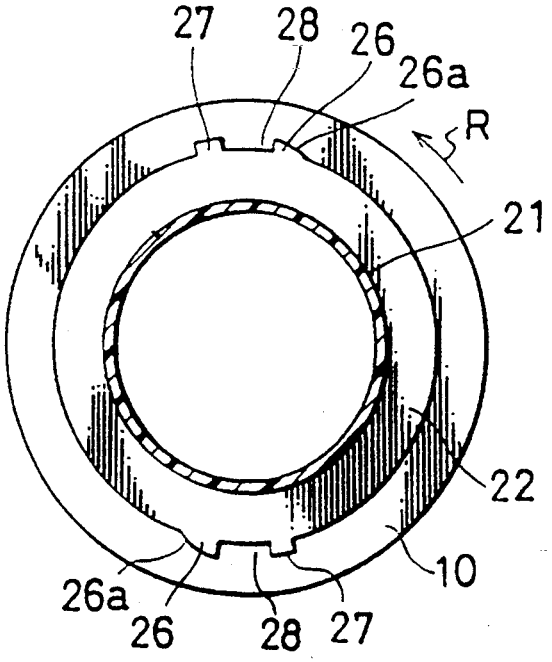
FIG. 3 is a sectional view taken along the line II—II in FIG. 4.
Figure 4:
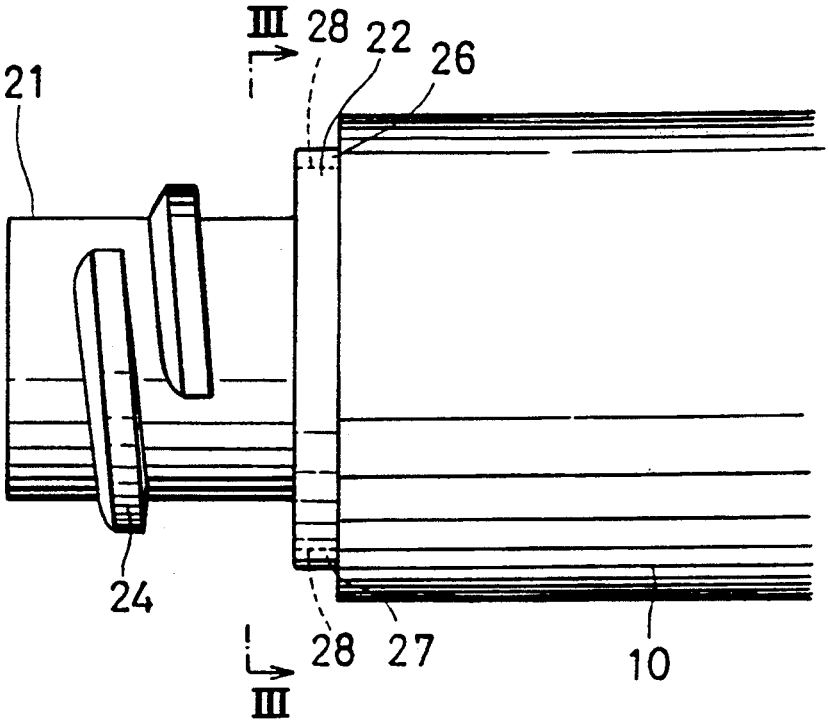
FIG. 4 is a front view showing a lead end portion of a casing of the liquid applicator.
Figure 5:
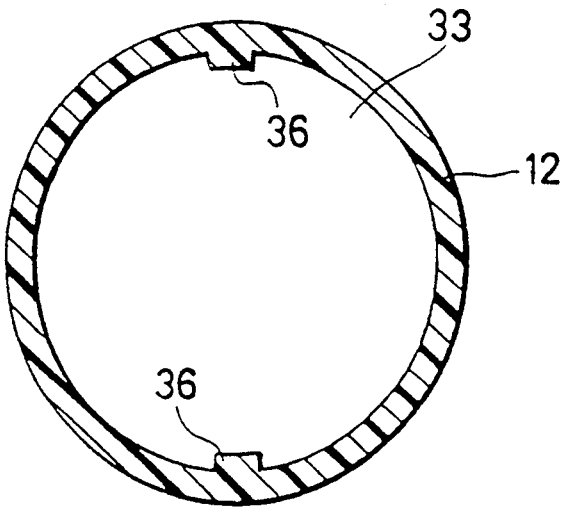
FIG. 5 is a sectional view taken along the line V—V in FIG. 6.
Figure 6:
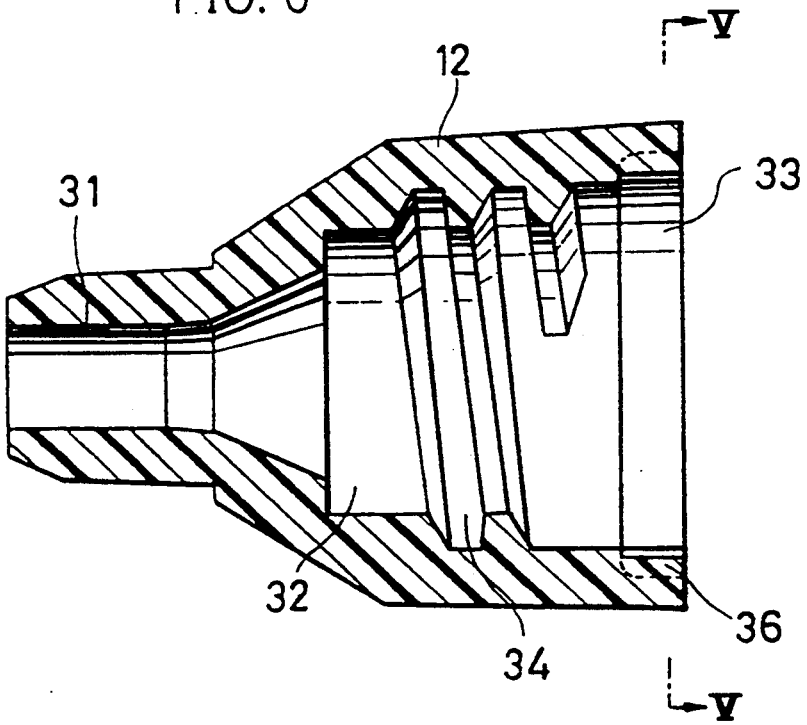
FIG. 6 is a front view in section showing a lead portion of the liquid applicator.

Indicated at R in FIGS. 1 and 3 is a rotating direction of the lead portion 12 when the lead portion 12 is spirally coupled with the casing 10. It will be appreciated that the spiral rotating direction of the casing 10 is opposite to the spiral rotating direction of the lead portion 12. Specifically, in upper parts of FIGS. 1 and 3, a right side is forward with respect to the spiral rotating direction of the casing 10, while being backward with respect to the spiral rotating direction of the lead portion 12. Likewise, in lower parts of FIGS. 1 and 3, a left side is backward with respect to the spiral rotating direction of the casing 10, while being forward with respect to the spiral rotating direction of the lead portion 12. Hereafter, the spiral rotating direction refers to the direction of R when members of the lead portion 12 are described, whereas it refers to a direction opposite to the direction of R when members of the casing 10 are described.

Out of opposite side faces of each first engaging projected portion 26, the forward side face with respect to the spiral rotating direction is formed into a slanting face 26*a*. More specifically, the slanting face 26*a* is configured into such a curved face that it looks like a part of an ellipse divided into four parts when viewed from the front, and the height thereof is increased gradually. On the contrary, the backward side face of each engaging projected portion 26 with respect to the spiral rotating direction is formed into an upright face extending in a direction normal to the outer circumferential surface of the large cylinder 22 (i.e., in radial directions of the liquid applicator). Opposite side faces of each restricting projected portion 27 are formed into upright faces extending in the radial directions of the liquid applicator.

On the other hand, the lead portion 12 is provided with a lead bore portion 31 having a bore of the smallest diameter, a small bore portion 32 having a bore of a small diameter, and a large bore portion 33 having a bore of a large diameter, which are arranged one after another in this order from the lead end of the lead portion 12 as shown in FIGS. 1, 2, 5, and 6. On an inner circumferential surface of the small bore portion 32 is formed an internal thread 34 which is spirally engageable with the external thread 24. A bore diameter of the large bore portion 33 is set such that the large cylinder portion 22 including the external thread 24 and the projected portions 26, 27 can be entirely inserted into the large bore portion 33.

On an inner circumferential surface of the large bore portion 33, a second engaging projected portion 36 which projects radially inward is projected in each of positions opposed to the grooves 28 in a state where both the threads 24, 34 are completely spirally engaged. The width of each second engaging projected portion 36 is set such that the portions 36 are fitted in the grooves 28, and opposite side faces thereof are both formed into upright faces extending the radial directions of the liquid applicators.

An assembling operation of this liquid applicator will be described next.

First of all, the lead portion 12 is rotated in a direction of R shown in FIGS. 1 and 3 so as to be fitted to the casing 10 while interposing the seal member 20 between the casing 10 and the lead portion 12, and thereby the threads 24, 34 are spirally engaged. As the threads 24, 34 are further spirally engaged, the lead portion 12 moves toward the bottom end of the liquid applicator gradually. Immediately before the threads 24, 34 are completely spirally engaged, the second engaging projected portions 36 formed on the lead portion 12 come into contact with the slanting faces 26*a* of the first engaging projected portions 26 formed on the casing 10, and slide over the slanting faces 26*a*, thereby moving over the first engaging projected portions 26. Thereupon, the second engaging projected portions 36 are fitted in the grooves 28 defined between the first engaging projected portions 26 and the restricting projected portions 27. When the spiral engagement of the threads 24, 34 is completed, the seal member 20 is tightly held between the casing 10 and the lead portion 12 (a state shown in FIGS. 1 and 2).

After the second engaging projected portions 36 are fitted in the grooves 28 in this way, the upright side faces of the first engaging projected portions 26 are in contact with the upright side faces of the second engaging projected portions 36. Thus, even if the lead portion 12 is rotated in a direction opposite to the direction of R, the second engaging projected portions 36 can in no way move over the first engaging projected portions 26. In other words, the lead portion 12 is prevented from rotating in the direction opposite to the direction of R relative to the casing 10, thereby reliably preventing the loosening of the spiral engagement of the threads 24, 34.

As described above, in this liquid applicator, the first and second engaging projected portions 26, 36 are formed such that the second engaging projected portions 36 move over the first engaging projected portions 26 when the threads 24, 34 are completely spirally engaged, and such that the second engaging projected portions 36 cannot move back over the first engaging projected portions 26 once they move over the first engaging projected portions 26. Accordingly, loosening of the threads 24, 34 can be reliably prevented, and the user can recognize the completion of spiral engagement of the threads 24, 34 easily by the sounds made when the second engaging projected portions 36 move over the first engaging projected portions 26. The invention is particularly beneficial to liquid applicators in which the seal member 20 is held tightly between the lead portion 12 and the casing 10 when the spiral engagement of the threads is completed such as the one shown in this embodiment, because the airtightness in the interior of the liquid applicators can be satisfactorily maintained by preventing the loosening of the spiral engagement.

Further in this embodiment, the restricting projected portions 27 are formed backward of the first engaging portions 26 with respect to the spiral rotating direction, and the second engaging projected portions 36 are fitted in the grooves 28 defined between the projected portions 26 and 27. Accordingly, the lead portion 12 is prevented from moving in the direction of R relative to the casing 10 after the second engaging projected port ions 26 are fitted in the grooves 28. Therefore, an engagement completed position can be accurately fixed.

The invention is not limited to the foregoing embodiment, but may also be embodied in the following manners, for example.

(1) In the foregoing embodiment, the forward side faces of the first engaging projected portions 26 with respect to the spiral rotating direction are formed into the slanting faces 26*a*, and the forward side faces of the second engaging projected portions 36 with respect to the spiral rotating direction are formed into the upright faces. However, the forward side faces of the first engaging projected portions 26 may be formed into upright faces, and instead the forward side faces of the second engaging projected portions 36 may be formed into slanting faces. This arrangement also enables the second engaging projected portions 36 to move over the first engaging projected portions 26 when the spiral engagement of the threads 24, 34 is completed. Further, the forward side faces of both the engaging projected portions 26 and 36 may be formed into the slanting faces.

(2) In the foregoing embodiment, the grooves 28 in which the second engaging projected portions 36 are fitted are defined on the outer circumferential surface of the casing 10. However, grooves may be defined on the inner circumferential surface of the lead portion 12 such that the engaging projected portions formed on the casing 10 are fitted in these grooves.

(3) In the foregoing embodiment, there is shown a liquid applicator in which the external thread 24 is formed on the casing 10 while the internal thread 34 is formed on the lead portion 12. However, the invention is also applicable to a liquid applicator as shown in FIGS. 8 and 9 in which an internal thread 34 is formed on an inner circumferential surface of the casing 10, and an external thread 24 spirally engageable with the internal thread 34 is formed on an outer circumferential surface of the lead portion 12.

(4) In the foregoing embodiment, the engaging projected portions 26, 36 are formed in positions more toward the bottom end of the liquid applicator than the respective threads 24, 34. However, these projected portions 26, 36 may be formed in positions more toward the lead end of the liquid applicator than the threads 24, 34. In this case, it may be appropriate to provide a cylinder portion whose diameter is smaller than that of the external thread 24 in a position more toward the lead end of the liquid applicator than the thread 24, to provide a bore portion having a bore whose diameter is greater than that of the internal thread 34, and to form engaging projected portions on outer and inner circumferential surfaces of the cylinder portion and the bore portion respectively. Likewise, in liquid applicators in which the internal thread is formed on the inner circumferential surface of the casing 10 and the external thread is formed on the outer circumferential surface of the lead portion 12, engaging projected portions can be provided either more toward the bottom end or more toward the lead end of the liquid applicator.

Figure 10C:
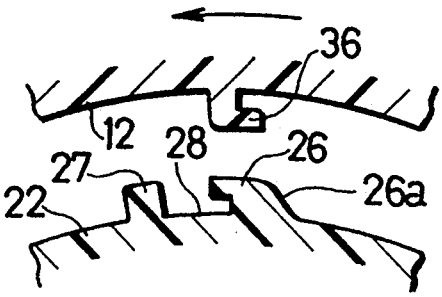
Figure 10D:
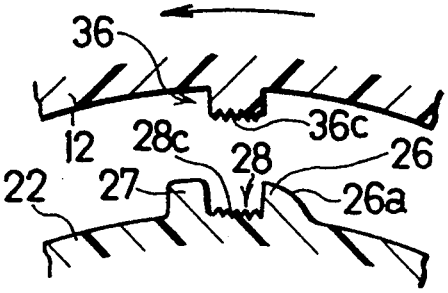

(5) The first and second engaging projected portions according to the invention may take any form provided that one of the engaging projected portions can move over the others in the spiral rotating direction, but cannot move over the others in the direction opposite to the spiral rotating direction. Besides those described in the foregoing embodiment, various other modifications can be considered. For instance, the backward side faces (right side face in FIG. 10A) of the second engaging projected portions 36 and the backward side faces of the first engaging projected portions 26 with respect to the spiral rotating direction may be formed into slanting faces which extend in the same direction as the slanting faces 26*a* as shown in FIG. 10*a*. In this case, the second engaging projected portions 36 are prevented more reliably from moving over the first engaging projected portions 26 in the direction opposite to the spiral rotating direction after moving over the first engaging projected portions 26 in the spiral rotating direction. It may be also appropriate to form stepped portions 36*a*, 36*b* whose heights differ from each other on each engaging projected portion 36, and to form stepped portions 28*a*, 28*b* in which the stepped portions 36*a*, 36*b* are fitted on the outer circumferential surface of the large cylinder portion 22 as shown in FIG. 10B. Further, as shown in FIG. 10C, the second engaging projected portions 36 may be each formed into a hooked shape curved backward with respect to the spiral rotating direction, and the first engaging projected portions 26 may be each formed into a hooked shape curved in the opposite direction which are engageable with the second engaging projected portions 36. Moreover, as shown in FIG. 10D, rib portions 36*c* and 28*c* which are engageable with each other may be formed on an inner circumferential face (lower face in FIG. 10D) of each second engaging projected portion 36 and on an outer circumferential surface (upper surface in FIG. 10D) of the large cylinder portion 22.

As described above, according to the invention, engaging projected portions are formed on opposing circumferential surfaces of a casing and a hollow lead portion which are spirally coupled with each other. These engaging projected portions are formed such that, after moving over the other engaging projected portion in one direction when threads formed on the casing and the lead portion are completely spirally engaged, one engaging projected portion cannot move over the other in an opposite direction. This reliably prevents the spiral engagement of the threads from loosening while a liquid applicator is used, thereby reliably preventing leakage of the liquid to be applied. Particularly in the case where a seal member is provided between the casing and the lead portion when the threads are completely spirally engaged, the airtightness in the interior of the liquid applicator can be satisfactorily maintained by preventing the loosening of the spiral engagement. Thus, such liquid applicators are particularly effective.

Further, a restricting projected portion is formed backward of one engaging projected portion with respect to the spiral rotating direction, thereby defining a groove between these two projected portions, and the other engaging projected portion is fitted in this groove. Thus, in this state, the lead portion is prevented from rotating forward in the spiral direction relative to the casing. This is advantageous in fixing an engagement-completed position accurately.

Although the present invention has been fully described by way of example with reference to the accompanying drawings, it is to be understood that various changes and modifications will be apparent to those skilled in the art. Therefore, unless such changes and modifications depart from the scope of the present invention, they should be construed as being included therein.

What is claimed is:

1. A liquid applicator comprising:

a tubular casing having an external thread formed on an outer circumferential surface thereof;

a hollow lead portion having an internal thread formed on an inner circumferential surface thereof, the lead portion being mountable on the casing by spirally engaging the external and internal threads;

an engaging projected portion formed in a specified position on each of the outer circumferential surface of the casing and the inner circumferential surface of the lead portion, the specified positions corresponding to each other in a state where the external and internal threads are completely spirally engaged with each other, these engaging projected portions being formed such that one engaging projected portion is allowed to move over the other in a spiral rotating direction, but is not allowed to move over the other in a direction opposite to the spiral rotating direction; and a restricting projected portion formed adjacent to the other of said engaging projected portions so as to form, in combination with the other engaging projected portion, a groove for holding the one engaging projected portion from moving in both said spiral rotating direction and a rotating direction opposite said spiral rotating direction, wherein a space is defined between the outer circumferential surface of said casing and the inner circumferential surface of said lead portion, wherein the height of each of said engaging projected portions and said restricting projected portion is less than or equal to the distance between the outer circumferential surface of said casing and the inner circumferential surface of said lead portion, and wherein a seal member is provided between the casing and the lead portion in a state where the external and internal threads are completely spirally engaged with each other.

2. A liquid applicator comprising:

a tubular casing having an internal thread formed on an inner circumferential surface thereof;

a hollow lead portion having an external thread formed on an outer circumferential surface thereof, the lead portion being mountable on the casing by spirally engaging the external and internal threads;

an engaging projected portion formed in a specified position on each of the inner circumferential surface of the casing and the outer circumferential surface of the lead portion, the specified positions corresponding to each other in a state where the external and internal threads are completely spirally engaged with each other, these engaging projected portions being formed such that one engaging projected portion is allowed to move over the other in a spiral rotating direction, but is not allowed to move over the other in a direction opposite to the spiral rotating direction; and a restricting projected portion formed adjacent to the other of said engaging projected portions so as to form, in combination with the other engaging projected portion, a groove for holding the one engaging projected portion from moving in both said spiral rotating direction and a rotating direction opposite said spiral rotating direction, wherein a space is defined between the inner circumferential surface of said casing and the outer circumferential surface of said lead portion, wherein the height of each of said engaging projected portions and said restricting projected portion is less than or equal to the distance between the inner circumferential surface of said casing and the outer circumferential surface of said lead portion, and wherein a seal member is provided between the casing and the lead portion in a state where the external and internal threads are completely spirally engaged with each other.

3. A liquid applicator as defined in claim 1 or 2 wherein a forward side face of at least one engaging projected portion with respect to the spiral rotating direction is formed into a slanting face such that the one engaging projected portion is allowed to move over the other, and a backward side face of each engaging projected portion with respect to the spiral rotating direction is formed into an upright face.

4. A liquid applicator as defined in claim 1 or 2 wherein a forward side face of at least one engaging projected portion with respect to the spiral rotating direction is formed into a first slanting face such that the one engaging projected portion is allowed to move over the other, and a backward side face of each engaging projected portion with respect to the spiral rotating direction is formed into a slanting face which extends in the same direction with the first slanting face.

5. A liquid applicator as defined in claim 1 or 2 wherein a first stepped portion having stages whose heights differ from each other is formed on a face of one engaging projected portion, and a second stepped portion fittable with the first stepped portion is formed on a face of a member mating with the one engaging projected portion.

6. A liquid applicator as defined in claim 1 or 2 wherein a first rib portion is formed on a face of one engaging projected portion, and a second rib portion fittable with the first rib portion is formed on a face of a member mating with the one engaging projected portion.

7. A liquid applicator as defined in claim 1 or 2 wherein one engaging projected portion is formed into a hooked shape curved backward with respect to the spiral rotating direction, and the other engaging projected portion is formed into a hooked shape which is engageable with the one engaging projected portion.

* * * * *